US008166882B2

(12) United States Patent
Yang

(10) Patent No.: US 8,166,882 B2
(45) Date of Patent: May 1, 2012

(54) SHAPED CHARGE LINER WITH VARYING THICKNESS

(75) Inventor: Wenbo Yang, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 320 days.

(21) Appl. No.: 12/489,834

(22) Filed: Jun. 23, 2009

(65) Prior Publication Data

US 2010/0319562 A1 Dec. 23, 2010

(51) Int. Cl.
*F42B 1/028* (2006.01)

(52) U.S. Cl. ..... 102/476; 102/306; 102/307

(58) Field of Classification Search ..... 102/306, 102/307, 475, 476
See application file for complete search history.

(56) References Cited

U.S. PATENT DOCUMENTS

| | | | | | |
|---|---|---|---|---|---|
| 2,856,850 | A * | 10/1958 | Church et al. | ..... | 102/307 |
| 3,218,975 | A * | 11/1965 | Massey | ..... | 102/476 |
| 3,235,005 | A * | 2/1966 | Delacour | ..... | 166/299 |
| 3,478,685 | A * | 11/1969 | Thomanek et al. | ..... | 102/306 |
| 3,732,816 | A * | 5/1973 | Muller | ..... | 102/306 |
| 4,327,642 | A * | 5/1982 | Grosse-Benne et al. | ..... | 102/307 |
| 4,338,713 | A * | 7/1982 | Christopher | ..... | 419/11 |
| 4,365,556 | A * | 12/1982 | Reibel | ..... | 102/307 |
| 4,436,033 | A * | 3/1984 | Precoul | ..... | 102/307 |
| 4,474,113 | A * | 10/1984 | Kyro et al. | ..... | 102/306 |
| 4,537,132 | A * | 8/1985 | Sabranski et al. | ..... | 102/307 |
| 4,672,896 | A * | 6/1987 | Precoul et al. | ..... | 102/309 |
| 4,982,667 | A * | 1/1991 | Weimann | ..... | 102/476 |
| 5,251,530 | A * | 10/1993 | Kaeser | ..... | 86/20.14 |
| 5,614,692 | A * | 3/1997 | Brown et al. | ..... | 102/307 |
| 5,859,383 | A * | 1/1999 | Davison et al. | ..... | 102/307 |
| 6,186,070 | B1 * | 2/2001 | Fong et al. | ..... | 102/476 |
| 6,349,649 | B1 | 2/2002 | Jacoby | | |
| 6,840,178 | B2 | 1/2005 | Collins | | |
| 6,868,791 | B1 * | 3/2005 | Thompson et al. | ..... | 102/476 |
| 6,983,698 | B1 * | 1/2006 | Walters et al. | ..... | 102/307 |
| 7,600,476 | B1 * | 10/2009 | Baker et al. | ..... | 102/476 |
| 7,658,150 | B2 * | 2/2010 | Ronn et al. | ..... | 102/476 |
| 2002/0017214 | A1 | 2/2002 | Jacoby | | |

FOREIGN PATENT DOCUMENTS

| | | |
|---|---|---|
| GB | 2271831 | 4/1994 |

* cited by examiner

*Primary Examiner* — Bret Hayes
*Assistant Examiner* — Joshua Freeman
(74) *Attorney, Agent, or Firm* — Chadwick A. Sullivan

(57) ABSTRACT

A shaped charge has a case defining a volume therein. A liner is located in the volume. An explosive is located between the case and the liner. The liner defines an interior volume and an opening thereto. The liner also has an apex portion that is distal from the opening. The liner has a first thick portion and a second thick portion. A thin portion is located between the first thick portion and the second thick portion in a direction extending from the apex portion along the liner toward the opening. The thin portion is thinner than the first thick portion and thinner than the second thick portion.

20 Claims, 5 Drawing Sheets

SHAPED CHARGE LINER WITH VARYING THICKNESS

TECHNICAL FIELD

The present application relates generally to perforating and more specifically to shaped charges having liners with varying thicknesses.

BACKGROUND

A shaped charge, in general, can have a metal charge case. High explosive material is disposed inside the case. A liner retains the explosive material in the case. A primer column can provide a detonating link between a detonating cord and the main explosive.

When the shaped charge is detonated a portion of the liner forms a jet portion which can be moving at a velocity of ~1 km/sec. (tail) to ~7 km/sec. (tip). The jet is propelled away from the case in a direction toward a target. Another portion of the liner is propelled away from the casing and forms what is known as a slug or carrot portion which is moving at a velocity of only a few hundred meters per second. When the shaped charge is used in a perforating gun, the target is normally the downhole formation rock. Upon detonation, the jet portion of the liner is propelled through the case and penetrates the downhole formation to enhance recovery of downhole hydrocarbons. The slug portion, in general, is designed to breakup to avoid plugging the hole on the casing formed by the jet.

Often times, about ~30 percent of the shaped charge liner mass is converted into the jet. The jet density, velocity profile, jet material, jet straightness, and target properties determine the ability of the jet to penetrate a given target.

A factor determinative of the jet velocity profile is the thickness profile of the liner. More particularly, as described herein in connection with embodiments, a varying cross-sectional thickness of the liner can produce a jet formed of essentially separate parts (i.e., a segmented jet) that improves penetration over a single part jet (i.e., a linear jet). This idea is illustrated in FIGS. 7-9.

Liners for shaped charges can been fabricated using pure metals, alloys, ceramics or a combination of them. The metals used to form the liners can be powder metals, which may, for example, comprise of tungsten, lead or copper. Liners for shaped charges can be fabricated using different solid materials for the jet and the slug. One such example of a liner utilizes solid copper for the jet and solid zinc for the slug. Liners can be pressed, forged, or made by any other known production method.

Depth of penetration is important in the perforating art and constant improvement is desired. Embodiments herein address that issue and others related thereto.

SUMMARY

The following is a brief summary according to features of the present application.

Embodiments in the present application relate to a shaped charge having a case defining a volume therein. A liner is located in the volume. An explosive is located between the case and the liner. The liner defines an interior volume and an opening thereto. The liner also has an apex portion that is distal from the opening. The liner comprises a first thick portion and a second thick portion. A thin portion is located between the first thick portion and the second thick portion in the direction extending from the apex along the liner toward the opening. The thin portion is thinner than the first thick portion and thinner than the second thick portion.

Other or alternative embodiments having fewer or additional features will be apparent from the following description, from the drawings, and from the claims.

BRIEF DESCRIPTION OF THE DRAWINGS

Certain embodiments are described with reference to the accompanying drawings, wherein like reference numerals denote like elements, and.

The figures mentioned herein are meant to help illustrate various features and are not meant in any way to unduly limit the scope of any present or future claims related to this application.

DETAILED DESCRIPTION

In the following description, numerous details are set forth to provide an understanding of various embodiments and related features. However, it will be understood by those skilled in the art that those embodiments presented may be practiced without these details and that numerous variations or modifications from the described embodiments may be possible.

In the specification and appended claims, the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly described some embodiments.

Figure 1:
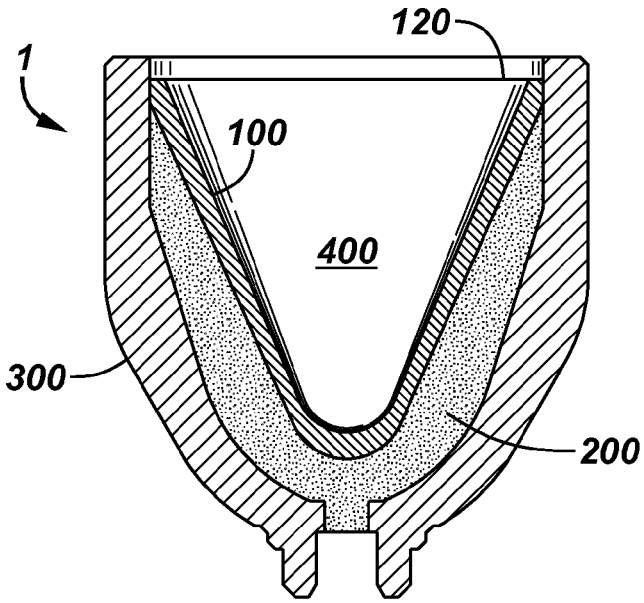
FIG. 1 shows a typical shaped charge including a case and a liner.

The present application relates to shaped charges. FIG. 1 shows a shaped charge 1 having a liner 100, explosive 200 and a case 300. The case 300 defines an interior volume in which the liner 100 is positioned. The liner 100 defines an interior volume 400 and has an opening thereto. The opening is surrounded by a rim portion 120 of the liner 100. The explosive 200 is located between the liner 100 and the casing 300.

Figure 2:
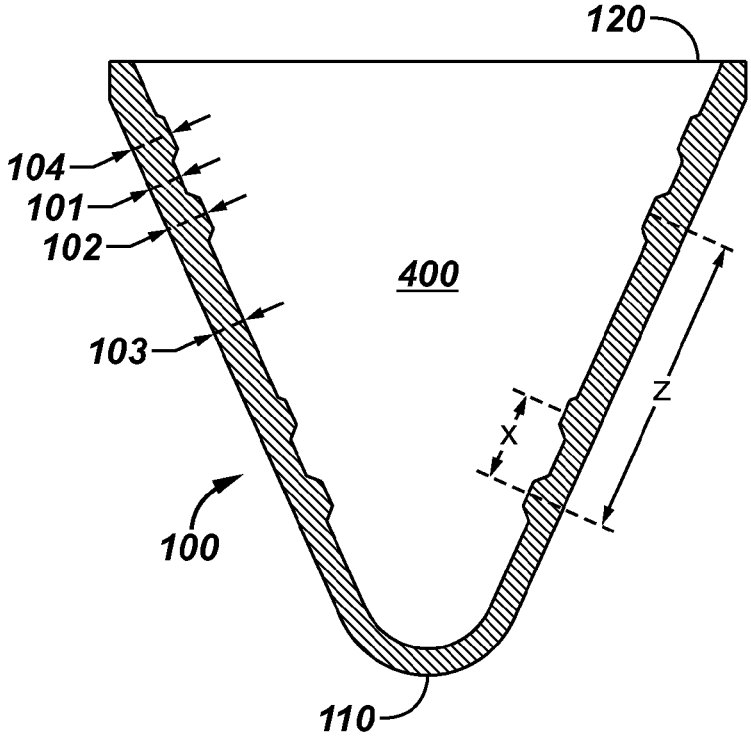
FIG. 2 shows a cross section of an embodiment of a liner according to an embodiment.

FIG. 2 shows an embodiment of a liner 100 having a "wavy" profile, e.g., having variations in the cross-sectional thickness of the liner. The liner 100 defines an interior volume 400 having an opening that is defined by a rim portion 120. An apex portion 110 is distal to the opening and the rim portion 120. The body of the liner 100 extends from the apex portion 110 to the rim portion 120 and has a varying cross-sectional thickness along that length as illustrated. For example, the liner 100 has a first thick portion having a thickness 102 and a second thick portion having a thickness 104. The liner has a thin portion with a thickness 101. The thickness 101 is smaller than the thickness 101 and the thickness 104. The thin portion is located between the first portion and the second portion along the liner 100 in the direction extending from the apex 110 to the rim portion 120, thereby defining a recess between the first thick portion and the second thick portion. Other portions having thickness 103 that is different or the same as the thickness 102, thickness 101 or thickness 104 is possible. The variations of the liner 100 producing the various thicknesses of the portions is shown as being present on one side of the liner 100, e.g., the inner surface of the liner 100. The variations of the liner 100 could be present on the outer surface of the liner. The thick/thin portion can extend circumferentially about the liner, e.g., perpendicular to a direction extending from the apex portion 110 to the opening/rim portion 120.

A distance x and a distance z are shown between thick portions. The distance x and z can be manipulated depending on desired performance.

Preferably the differences in thicknesses between the thick portion of the liner and the thin portion of the liner can be from a few percent of the liner thickness to ~50% to the thickness of the liner. For example, the difference could be anywhere between 5%-10%, 10%-20%, 20%-30%, 30%-40%, or 40%-50%.

Figure 3:
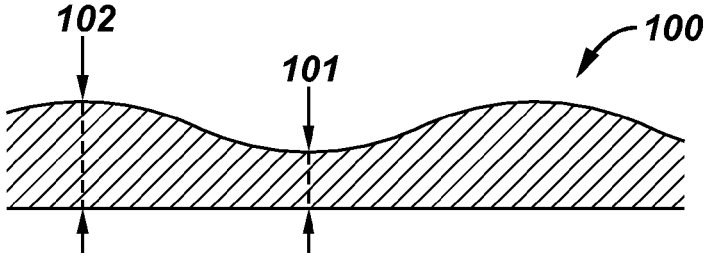
FIG. 3 shows a cross section of a portion of a liner according to an embodiment.

FIG. 3 shows a close-up of a portion of the liner 100 according to an embodiment. A thin portion of the liner 100 has a thickness 101 adjacent to a thick portion of the liner 100 having a greater thickness 102. The transition between the thin portion and the thicker portion is a curved surface of the liner 100. This curve can generally be a sinusoidal type curve. The variations of the liner 100 producing the various thicknesses of the portions is shown as being present on one side of the liner 100, e.g., the inner surface of the liner 100. The variations of the liner 100 could be present on the outer surface of the liner.

Figure 4:
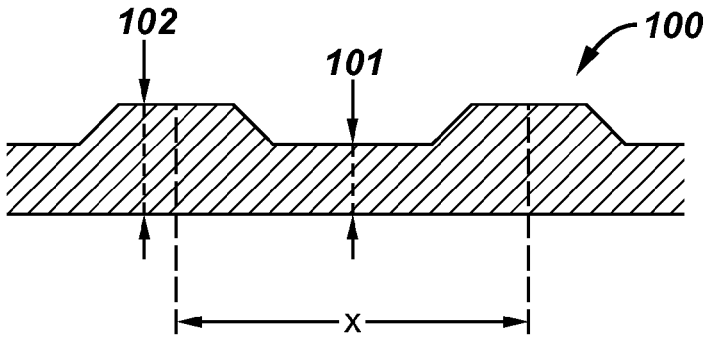
FIG. 4 shows a cross section of a portion of a liner according to an embodiment.

FIG. 4 shows a close-up of a portion of the liner 100 according to an embodiment. A portion of the liner 100 has a thin portion having a thickness 101 adjacent to a thicker portion having a greater thickness 102. There is a transition between the thin portion and the thick portion that is a flat surface angled with regard to the extension of the liner 100, e.g., a ramp shaped configuration. FIG. 3 shows a distance x between a portion of the thicker portions of the liner 100. The distance x extends along the direction extending from the apex portion 110 toward the rim portion 120. That distance can vary depending on desired performance. The variations of the liner 100 producing the various thicknesses of the portions is shown as being present on one side of the liner 100, e.g., the inner surface of the liner 100. The variations of the liner 100 could be present on the outer surface of the liner.

Figure 5:
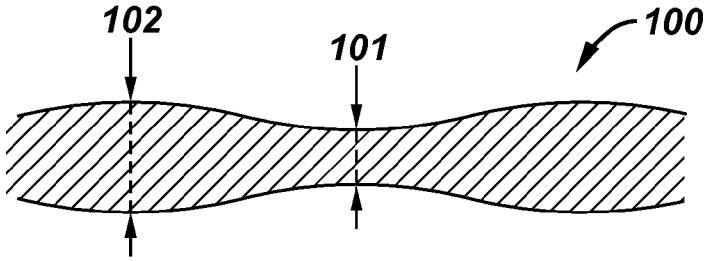
FIG. 5 shows a cross section of a portion of a liner according to an embodiment.

FIG. 5 shows a close-up of a portion of a liner 100 according to an embodiment. A thin portion of the liner 100 has a thickness 101 and a thick portion of the liner 100 has a thickness 102 adjacent to the thin portion. The variations of the liner 100 producing the various thicknesses of the portions can be on both sides of the liner 100, e.g., the inner surface of the liner 100 and the outer surface of the liner 100.

Figure 6:
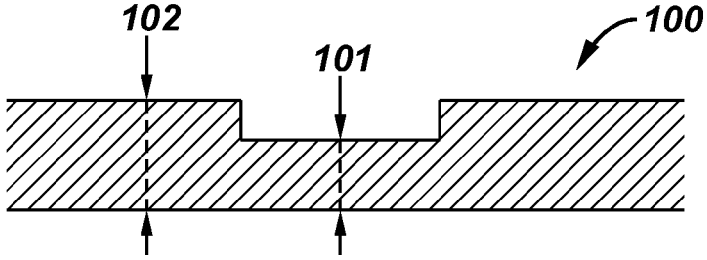
FIG. 6 shows a cross section of a portion of a liner according to an embodiment.

FIG. 6 shows a close-up of a portion of the liner 100 according to an embodiment. A thin portion of the liner 100 has a thickness 101 adjacent to a thick portion having a thickness 102. There is a transition between the thin portion and the thick portion that is stepped, e.g., in the shape of a step having a substantially vertical portion intersecting the two portions. The variations of the liner 100 producing the various thicknesses of the portions is shown as being present on one side of the liner 100, e.g., the inner surface of the liner 100. The variations of the liner 100 could be present on the outer surface of the liner.

Figure 7:
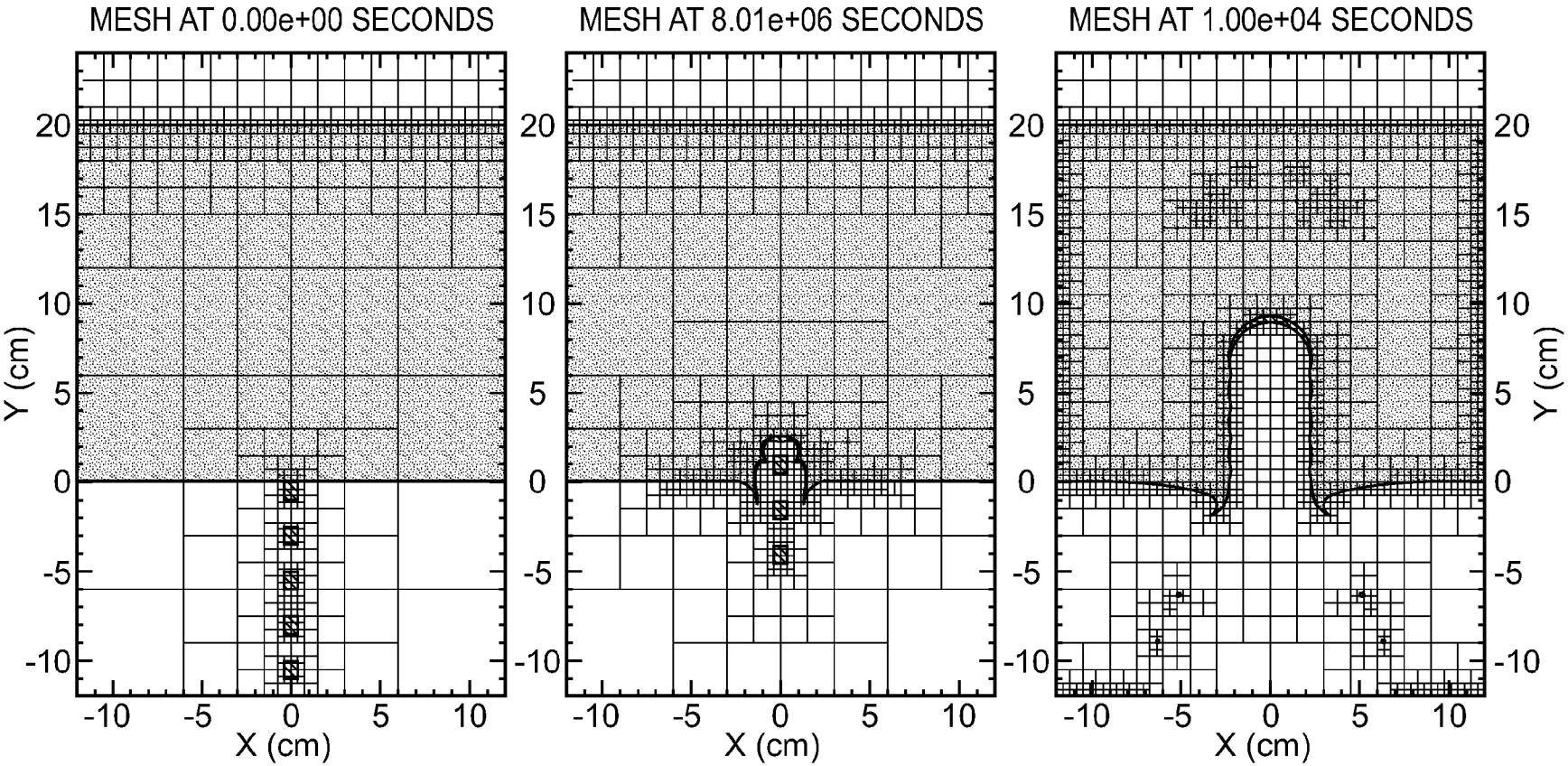
FIG. 7 shows a numerical simulation penetration result graphically where the jet is segmented due to variations in liner thickness.

FIG. 7 shows numerical simulation of penetration where the jet is segmented.

Figure 8:
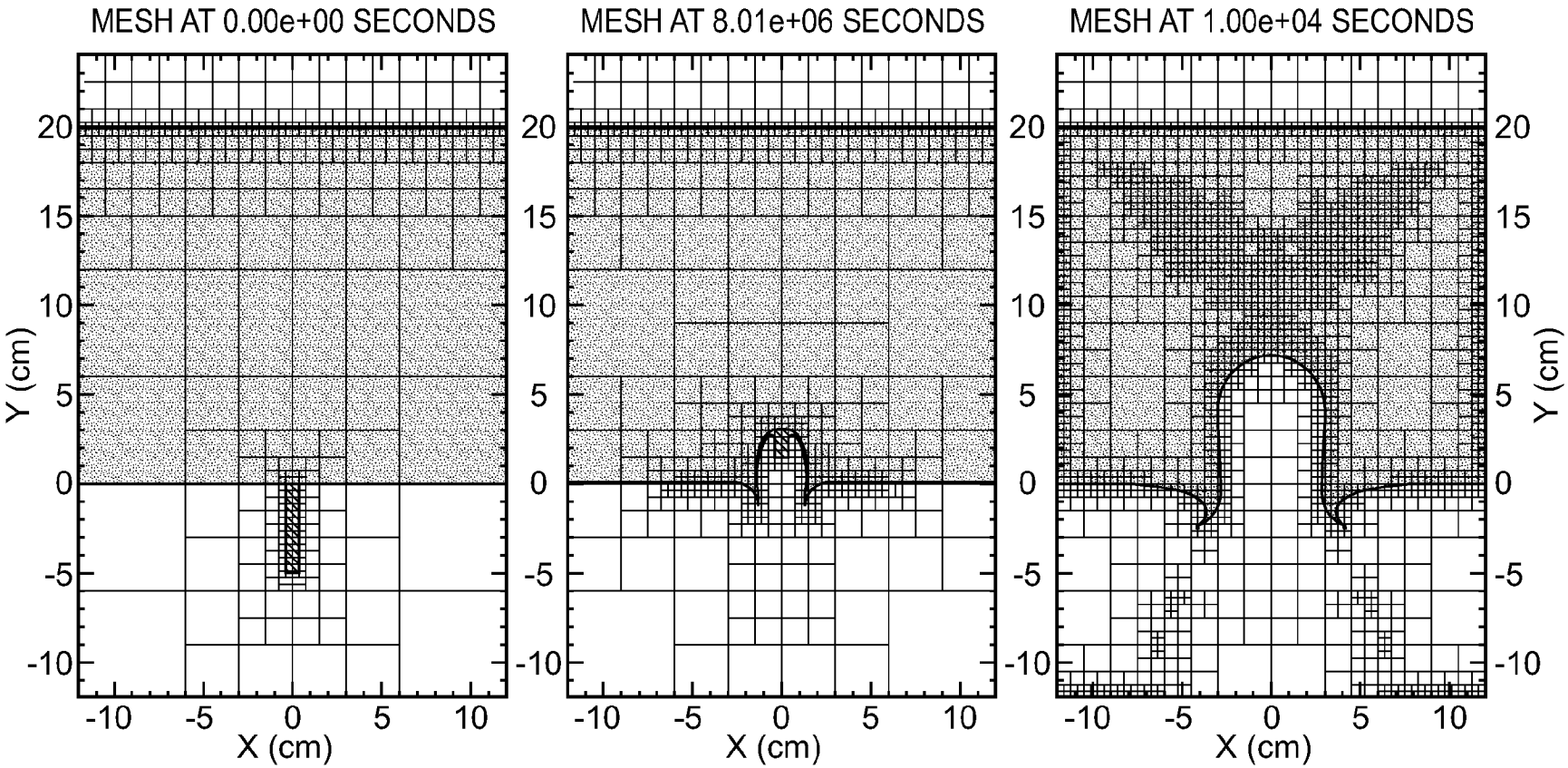
FIG. 8 shows a numerical simulation penetration result graphically where the jet is not segmented, e.g., a continuous jet.

FIG. 8 shows numerical simulation of penetration where the jet is not segmented, e.g., a continuous jet.

Figure 9:
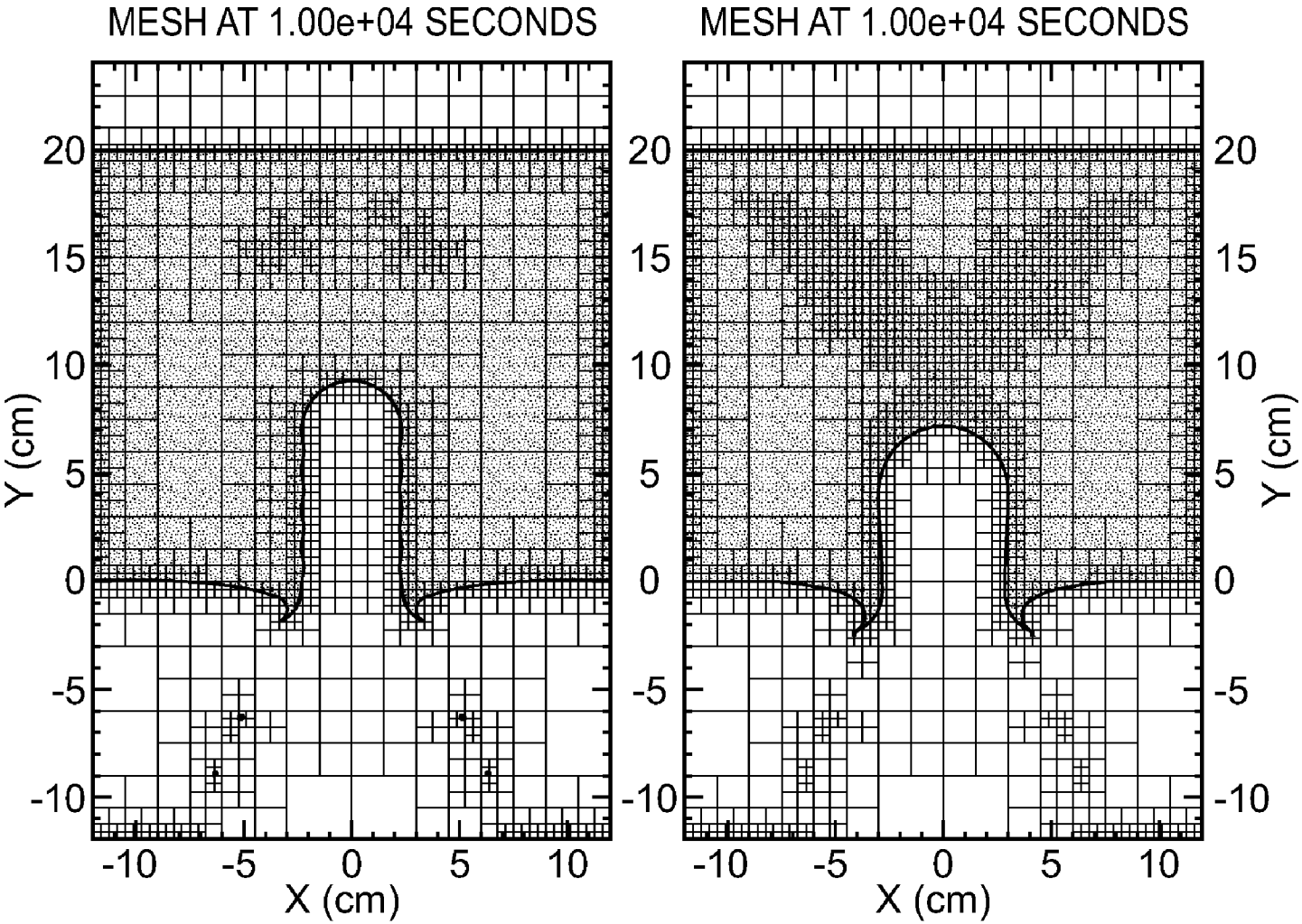
FIG. 9 shows a side-by-side comparison of the numerical simulation results between the segmented jet and the single part jet.

FIG. 9 shows a side-by-side comparison of the experimental results between the segmented jet and the continuous jet, thereby illustrating the improved penetration with the segmented jet which can be produced by the "wavy" liner with a varying thickness.

Although only a few embodiments have been described in detail above, those of ordinary skill in the art will readily appreciate that many modifications are possible without materially departing from the teachings of this application. Such modifications are intended to be included within the scope as defined in the present and any future claims.

What is claimed is:

1. A shaped charge providing a segmented jet upon detonation for resulting in improved penetration of a formation, the shaped charge comprising:
- a case defining a volume therein;
- an open end of the case providing access to the volume defined by the case;
- a liner connected to and enclosing the open end of the case;
- an explosive located between the case and the liner;
- a liner wall of the liner extending into the volume defined by the case to provide an interior volume of the liner and an opening thereto;
- an apex portion of the liner wall distal from the opening of the liner wall and positioned within the volume defined by the case;
- a first thick portion of the liner wall extending circumferentially about the apex portion;
- a first wall thickness of the first thick portion;
- a second thick portion of the liner wall spaced from the first thick portion and extending parallel to the first thick wall portion circumferentially about the apex portion;
- a second wall thickness of the second thick portion;
- a thin portion of the liner wall located between the first thick portion and the second thick portion and extending circumferentially about the apex portion; and
- a third wall thickness of the thin portion of the liner wall being thinner than the first wall thickness of the first thick portion and thinner than the second wall thickness of the second thick portion to provide a reduced liner wall strength along the thin portion so that the liner separates into separate components along the thin portion upon detonation of the explosive positioned between the case and the liner.

2. The shaped charge of claim 1, wherein the first thick portion, the second thick portion and the thin portion together make up a wavy portion of the liner, wherein the liner comprises at least two wavy portions.

3. The shaped charge of claim 1, wherein an interior surface of the liner has a sinusoidal type cross sectional pattern.

4. The shaped charge of claim 1, wherein an outside surface of the liner extends uninterrupted from the apex portion to a portion of the liner proximate the opening.

5. The shaped charge of claim 1, wherein an inside surface of the liner extends uninterrupted from the apex portion to a portion of the liner proximate the opening.

6. The shaped charge of claim 1, wherein the first thick portion and the thin portion transition between one another by way of a curved surface.

7. The shaped charge of claim 1, wherein the first thick portion and the thin portion transition between one another by way of a step shape.

8. A shaped charge liner configured to provide a segmented jet, comprising:

a wall member;

an interior volume defined by the wall member;

an opening provided by the wall member to access the interior volume;

a rim extending about the opening of the wall member;

an apex portion of the wall member distal from the opening;

a wall axis extending between the apex portion of the wall member and the rim portion;

spaced thick portions of the wall member extending perpendicular to the wall axis; and a thin portion of the wall member between the spaced thick portions sized to provide a break therealong when exposed to detonation of an explosive.

9. The shaped charge liner of claim 8, wherein the first thick portion, the second thick portion and the thin portion make up a wavy portion of the wall member, wherein the wall member comprises at least two wavy portions.

10. The shaped charge liner of claim 8, wherein an interior surface of the wall member has a sinusoidal type cross sectional pattern.

11. The shaped charge liner of claim 8, wherein an outside surface of the wall member extends uninterrupted from the apex portion to the portion of the wall member proximate the opening.

12. The shaped charge liner of claim 8, wherein an inside surface of the wall member extends uninterrupted from the apex portion to a portion of the wall member proximate the opening.

13. The shaped charge liner of claim 8, wherein the first thick portion and the thin portion transition between one another by way of a curved surface.

14. The shaped charge liner of claim 8, wherein the first thick portion and the thin portion transition between one another by way of a step shape.

15. A method of perforating a formation with a shaped charge having a segmentable liner, the method comprising:

placing a shaped charge adjacent a formation to be perforated;

detonating an explosive postioned between a case and a liner of the shaped charge;

segmenting the liner as a result of detonating the explosive along a thin portion of the liner extending circumferentially about an apex portion of the liner, the thin portion having a reduced wall thickness compared to the wall portions on either side of the thin portion; and perforating the formation with the multiple segments of the liner of the shaped charge.

16. The method of claim 15, wherein the thin portion and wall portions on either side thereof make up a wavy portion of the liner, wherein the liner comprises at least two wavy portions.

17. The method of claim 15, wherein an interior surface of the liner has a sinusoidal type cross sectional pattern.

18. The method of claim 15, wherein an outside surface of the liner extends uninterrupted from the apex portion to a portion of the liner proximate an opening of the liner opposite the apex portion.

19. The method of claim 15, wherein an inside surface of the liner extends uninterrupted from the apex portion to a portion of the liner proximate proximate an opening of the liner opposite the apex portion.

20. The method of claim 15, wherein the thin portion and wall portions on either side thereof transition between one another by way of a curved surface.

* * * * *